US005385258A

United States Patent [19]

Sutherlin

[11] Patent Number: 5,385,258

[45] Date of Patent: Jan. 31, 1995

[54] ANIMAL RESISTANT TRASH CONTAINER AND METHOD

[76] Inventor: David A. Sutherlin, 110 W. Nippino Trail, Nokomis, Fla. 34275

[21] Appl. No.: 131,482

[22] Filed: Oct. 4, 1993

[51] Int. Cl.[6] ..... B65D 45/00

[52] U.S. Cl. ..... 220/334; 220/324; 220/908

[58] Field of Search ..... 220/319, 324, 334, 730, 220/908; 206/223

[56] References Cited

U.S. PATENT DOCUMENTS

| | | | |
|---|---|---|---|
| 1,059,221 | 4/1913 | Saylor | 220/334 X |
| 1,629,747 | 5/1927 | Stathes et al. | 220/334 |
| 3,817,563 | 6/1974 | McGlothlin | 220/908 X |
| 4,320,851 | 3/1982 | Montoya | 220/908 X |
| 4,976,371 | 12/1990 | Wise et al. | 220/908 X |
| 5,033,520 | 7/1991 | Kuehmichel | 220/324 X |

*Primary Examiner*—Steven M. Pollard
*Attorney, Agent, or Firm*—Charles J. Prescott

[57] ABSTRACT

An improved animal tamper-resistant trash container and method of constructing same utilizing a conventional trash container having a bottom, side wall and an open upper end and removable lid therefor. The improvement includes a first and second annular band or ring each clampably connectable around the lid and container adjacent its opening, respectively. A hinge is formed between the first and second bands whereby the lid is permanently pivotally attached to the open upper end of the container. A unique latch, which automatically engages when the lid falls to a closed position, is virtually unopenable by large wild animals such as a raccoon, fox, opossum, dogs and the like.

12 Claims, 2 Drawing Sheets

ANIMAL RESISTANT TRASH CONTAINER AND METHOD

BACKGROUND OF THE INVENTION

Scope of Invention

This invention relates generally to trash containers, and more particularly to an improved trash container and method of converting a conventional trash container into one which is tamper resistant by animals.

Prior Art

Conventional trash containers, whether made of metal or molded plastic, are susceptible to be opened and entered by wild animals such as raccoons and the like. The lids provided with these conventional trash containers fit relatively snugly over the upper end of the trash container but are easily dislodged by clever animals seeking food.

Even conventional trash containers which include hinged lids do not include a releasable locking arrangement which is impervious to the clever mischievous ways of a raccoon, fox, and the like which can easily open such conventional locking arrangements.

The present invention provides an improved trash container formed of a conventional trash container and a method of converting same into one which is virtually tamper resistant to entry by wild animals and stray dogs as well.

BRIEF SUMMARY OF THE INVENTION

This invention is directed to an improved animal tamper-resistant trash container and method of constructing same utilizing a conventional trash container having a bottom, side wall and an open upper end and removable lid therefor. The improvement includes a first and second annular band or ring each clampably connectable around the lid and container adjacent its opening, respectively. A hinge is formed between the first and second bands whereby the lid is permanently pivotally attached to the open upper end of the container. A unique latch, which automatically engages when the lid falls to a closed position, is virtually unopenable by large wild animals such as a raccoon, fox, opossum, dogs and the like.

It is therefore an object of this invention to provide an improved trash container which includes a hinged, lockable lid impervious to being tampered with and opened by animals.

It is yet another object of this invention to provide a method of transforming a conventional trash container into one which includes a hinged lid and which is lockable in a closed position and tamper resistant to entry by wild animals such as raccoons, fox, stray dogs and the like.

It is yet another object of this invention to provide a hardware kit for converting a conventional trash container with a removable lid into an improved trash container with a pivotally connected lid and an animal tamper proof lid locking arrangement.

In accordance with these and other objects which will become apparent hereinafter, the instant invention will now be described with reference to the accompanying drawings.

DETAILED DESCRIPTION OF THE INVENTION

Figure 1:
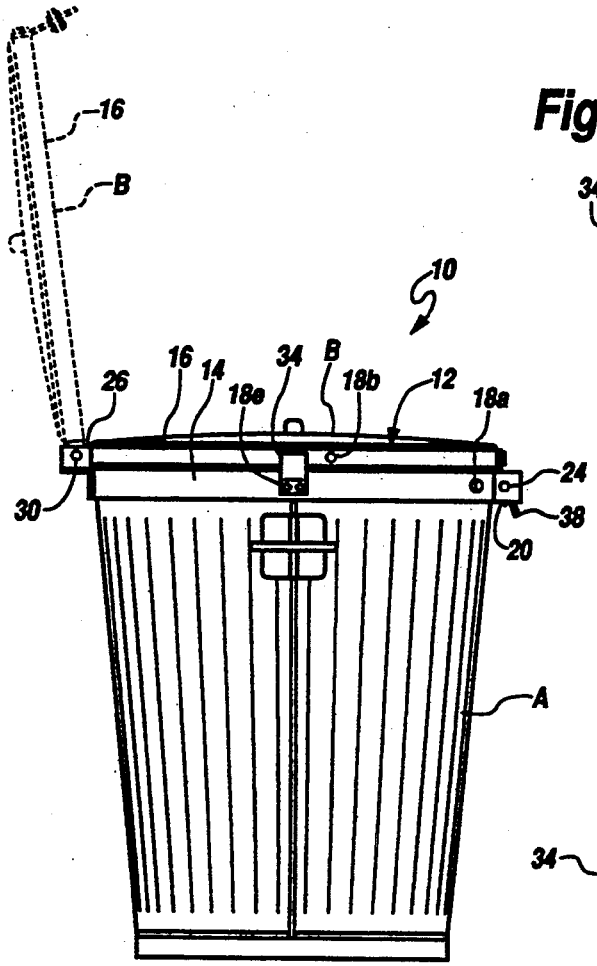
FIG. 1 is a side elevation view of the invention showing the lid thereof in an open position in phantom.
Figure 2:
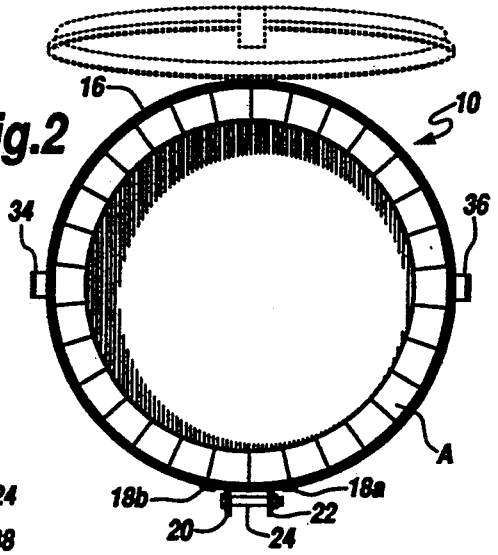
FIG. 2 is a top plan view of FIG. 1 showing the lid in phantom in its open position.
Figure 3:
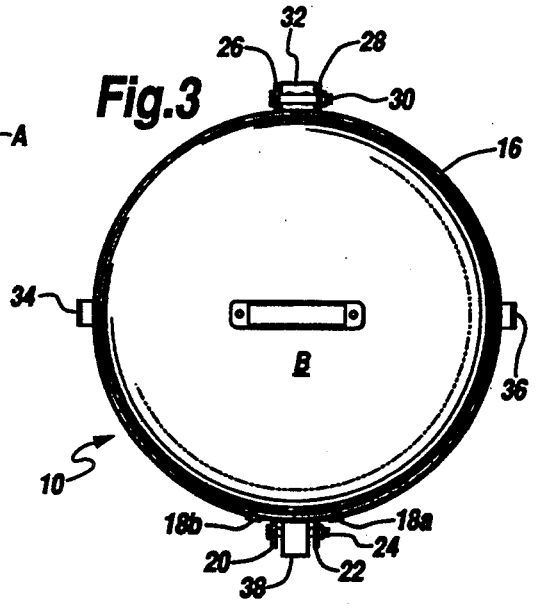
FIG. 3 is a top plan view of FIG. 1 showing the lid in its closed position.
Figure 4:
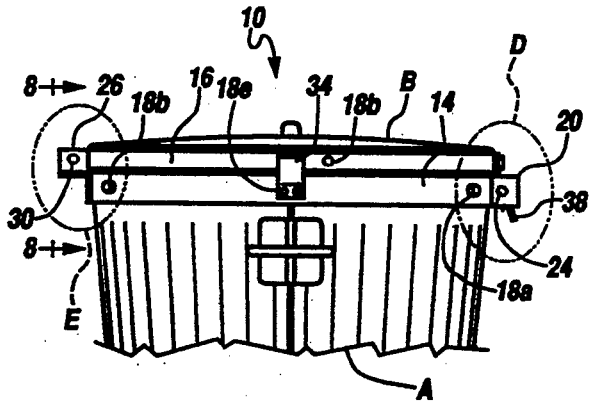
FIG. 4 is an enlarged side elevation view of the upper end of the invention shown in FIG. 1.
Figure 5:
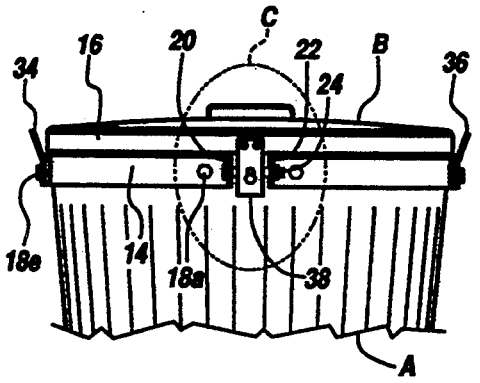
FIG. 5 is a front elevation view of FIG. 4.

Referring now to the drawings and firstly to FIGS. 1 to 5, the invention is shown generally at numeral 10 and includes a conventional galvanized metal trash container A (e.g. 20–50 gal. capacity) which is typically supplied with a separate handled metal lid B closably positionable onto the open upper end of the container A. The improvement is shown generally at numeral 12 and includes a first rigid metal annular band 14 which is clampably and boltably engagable by threaded fasteners 18*a* around the upper perimeter of container A adjacent its open upper end as shown. This band 14 is initially held in position by threaded striker bolt 24 acting when tightened to squeezably urge flanges 20 and 22 together.

The improvement 12 also includes a second rigid metal annular band 16 which is clampably engagable by threaded fastener 30 around the perimeter of lid 16. Again, bolts 18*b* are also provided to secure this second band 16 around lid B.

Figure 8:
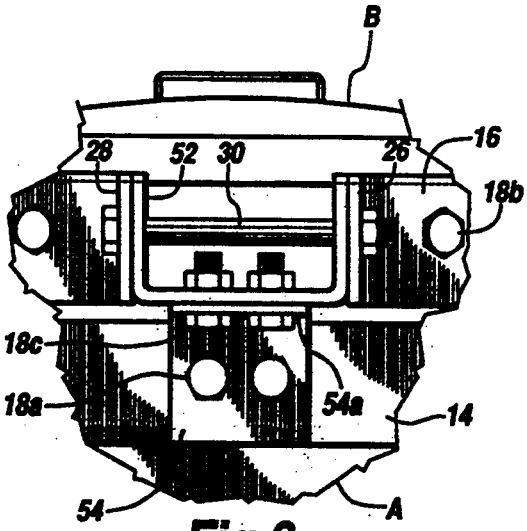
FIG. 8 is an enlarged view in the direction of arrows 8—8 in FIG. 4.
Figure 9:
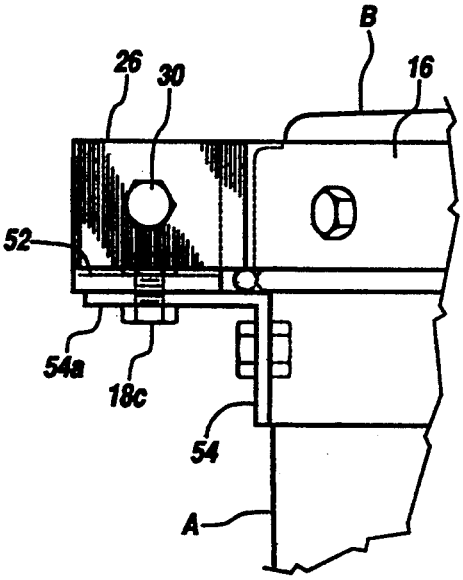
FIG. 9 is an enlarged view of area E shown in FIG. 4.

The first and second bands 14 and 16 are hingeally connected together by a hinge arrangement best seen in FIGS. 8 and 9. A rigid L-shaped bracket 54 is connected by threaded fasteners 18*a* to the first band 14. A U-shaped bracket 52 is bolted atop the horizontally outwardly extending flange 54*a* of L-shaped bracket 54 by threaded fasteners 18*c*. An elongated threaded fastener 30 interconnects the upwardly extending legs of U-shaped bracket 52 and outwardly extending flanges 26 and 28 of the second band 16. By this arrangement, a separate conventional lid B is rendered pivotally connected to the upper opening of container A.

To help insure that lid B pivotally falls into a fully closed position over the open upper end of the container A, guide plates 34 and 36 are boltably engaged in opposing fashion and generally orthogonal to the hinge arrangement on the first band 14. That is, each guide plate 34 and 36 are opposingly positioned at a mid point along the first band 14 between the hinge and the latch plate 38, each guide plate 34 and 36 diagonally extending upwardly and outwardly from the first band. Thusly, the opposing edges of the lid B will contact one of the other guide plates 34 or 36 so as to properly center the lid B over the open end of the container A as the lid B falls to a closed position.

One of the primary functions of the present invention, in addition to converting the separate lid B into one which is permanently pivotally connected to the container A is to provide a latch arrangement to maintain the lid B in its closed position even against the clever tampering of raccoon, fox, and the like. To accomplish this locking function which is nonetheless releasably manually openable to a human being of normal strength and intelligence, the second band 15 includes a diagonally downwardly and outwardly extending latch plate 38 boltably connected at its upper end to the second band 16 by threaded fasteners **18*d* as best seen in FIGS. 6 and 7**.

Adjustably connected through longitudinal slot 46 at a mid point along latch plate 38 is a threaded bolt 40 having a rounded enlarged head 50. Threaded nuts 42 and 44 tightened together secure bolt 40 in the position shown in FIG. 7 so that enlarged head 50 is positioned diagonally downwardly from latch plate 38 in the engaged position.

An enlarged freely rotatable washer 48 having a diameter larger than head 50 is also provided. By this arrangement, when the lid B is pivoted downwardly into a closed position and forced to a fully closed position as by hand pressure in the direction of arrow F, head 50 strikes striker bolt 24 and deflects the latch plate 38 outwardly in the direction of arrow H so that the locking bolt 40 will be positioned below striker bolt 24 in the arrangement shown in FIG. 7 to securely lock lid B in place. Washer 48 and head 50 prevent easy disengagement.

Figure 6:
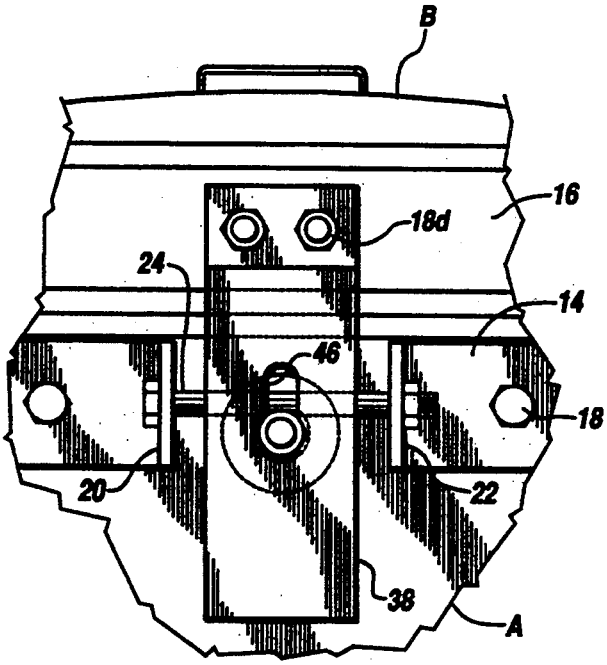
FIG. 6 is an enlarged view of area C shown in FIG. 5.
Figure 7:
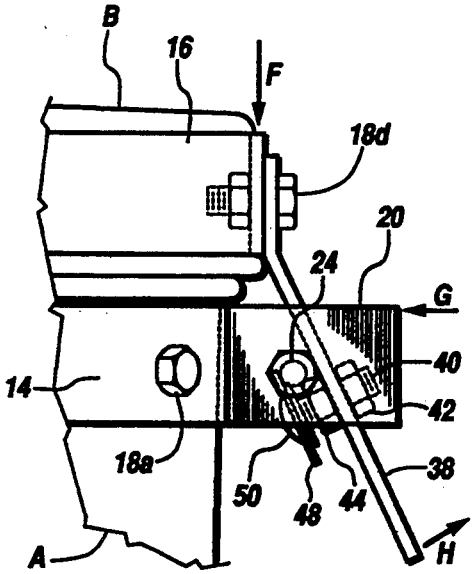
FIG. 7 is an enlarged view of area D shown in FIG. 4.

With the latch means in its locked and engaged position shown in FIGS. 6 and 7, a clever animal such as a raccoon, a fox, a wild dog and the like is unable to open the lid B. However, by again pulling latch plate 38 in the direction of arrow H while pressing down on the lid B in the direction of arrow F and exerting additional inward pressure to additionally resiliently deflect the upper opening of container A and the first band 14 in the direction of arrow G, disengagement of the latch means is relatively straightforward when opening lid B.

The invention will preferably be marketed as a kit for converting the conventional trash container A and lid B into the improved invention 10 as described hereinabove.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An improved animal resistant trash container constructed using a conventional trash container having a bottom and a side wall extending from said bottom to define an open end generally parallel to and spaced from said bottom, said conventional container including a separate lid which closably engages over said opening, the improvement comprising:

a first annular band clampably connectable around a transverse circumference of said container immediately adjacent said open end;

a second annular band clampably connectable around a perimeter of said lid;

a hinge pivotally connecting a common point of said first and second bands;

latch means for automatically releasably locking said lid after falling to its closed position.

2. An improved animal resistant trash container as set forth in claim 1, wherein said latch means includes:

an elongated striker bolt connected horizontally between two flanged ends of said first band for clampably connecting said second bands around said container;

said striker bolt positioned parallel to and slightly below and radially outwardly from said open end;

a latch plate connected to and downwardly and radially outwardly extending from said second band;

a locking bolt connected to and extending orthogonally from a mid point along said latch plate, said locking bolt having an enlarged head spaced downwardly from said latch plate and configured to contact said striker bolt as said lid is pivoted to the closed position, said latch plate being deflected away from said striker bolt sufficiently to allow said enlarged head to be positioned beneath said striker bolt locking said lid in the closed position.

3. An improved animal resistant trash container as set forth in claim 2, further comprising:

a freely rotatable flat washer positioned on said locking bolt against said enlarged head, said washer larger in diameter than said enlarged head;

said washer increasing the outward deflection of said latch plate required to move said locking bolt from beneath said strike bolt to open said lid.

4. An improved animal resistant trash container as set forth in claim 2, further comprising:

a pair of guide plates each connected to said first band in evenly spaced opposing arrangement one to another, each said guide plate being positioned at a mid point along said first band between said hinge and said latch means;

each said guide plate extending upwardly and outwardly from said first band.

5. A method of constructing an improved animal resistent trash container using a conventional trash container having a bottom and a side wall extending from said bottom to define an open end generally parallel to and spaced from said bottom, said conventional container including a separate lid which closably engages over said opening, comprising the steps of:

A. clampably connecting a first annular band around a transverse perimeter of said container immediately adjacent said open end;

B. clampably connecting a second annular band around a perimeter of said lid;

said first and second bands being pivotally connectable to one another by a hinge about a common generally tangent axis therebetween, said common axis being transverse to said container;

said first and second bands being automatically releasably lockable together by a latch means positioned diametrically opposite from said hinge so as to prevent said lid from being opened by an animal after pivotally falling to a closed position on said open end.

6. A method as set forth in claim 5, wherein said latch means comprises:

an elongated striker bolt connected horizontally between two flanged ends of said first band for clampably connecting said second bands around said container;

said striker bolt positioned parallel to and slightly below and radially outwardly from said open end;

a latch plate connected to and downwardly and radially outwardly extending from said second band;

a locking bolt connected to and orthogonally extending from a mid point along said latch plate, said locking bolt having an enlarged head spaced downwardly from said latch plate and configured to strike against said strike bolt as said lid is pivoted to the closed position; said latch plate being deflected away from said strike bolt sufficiently to allow said enlarged head to be positioned below said strike bolt locking said lid in the closed position.

7. A method as set forth in claim 6, wherein said latch means further comprises:

a freely rotatable flat washer positioned on said locking bolt against said enlarged head said washer larger in diameter than said enlarged head;

said washer increasing the outward deflection of said latch plate required to move said locking bolt from beneath said strike bolt to open said lid.

8. A method as set forth in claim 7, wherein said first band further comprises:

a pair of guide plates each connected to said first band in evenly spaced opposing arrangement one to another, each said guide plate being positioned at a mid point along said first band between said hinge and said latch means;

each said guide plate extending upwardly and outwardly from said first band, at least one peripheral margin of said lid contacting one said guide plate when said lid pivotally falls toward the closed position and is misaligned over said open end.

9. A kit for converting a conventional trash container having a separate lid into an improved animal resistant trash container, said kit comprising:

a first annular band clampably connectable around a transverse circumference of said container immediately adjacent said open end;

a second annular band clampably connectable around a perimeter of said lid; a hinge pivotally connecting a common point of said first and second bands;

latch means for automatically releasably locking said lid after falling to its closed position.

10. A kit as set forth in claim 9, wherein said latch means includes:

an elongated striker bolt connected horizontally between two flanged ends of said first band for clampably connecting said second bands around said container;

said striker bolt positioned parallel to and slightly below and radially outwardly from said open end;

a latch plate connected to and downwardly and radially outwardly extending from said second band;

a locking bolt connected to and extending orthogonally from a mid point along said latch plate, said locking bolt having an enlarged head spaced downwardly from said latch plate and configured to contact said striker bolt as said lid is pivoted to the closed position, said latch plate being deflected away from said striker bolt sufficiently to allow said enlarged head to be positioned beneath said striker bolt locking said lid in the closed position.

11. A kit as set forth in claim 10, further comprising:

a freely rotatable flat washer positioned on said locking bolt against said enlarged head, said washer larger in diameter than said enlarged head;

said washer increasing the outward deflection of said latch plate required to move said locking bolt from beneath said strike bolt to open said lid.

12. A kit as set forth in claim 4, further comprising:

a pair of guide plates each connected to said first band in evenly spaced opposing arrangement one to another, each said guide plate being positioned at a mid point along said first band between said hinge and said latch means;

each said guide plate extending upwardly and outwardly from said first band.

* * * * *